United States Patent [19]

Bader

[11] 4,240,403

[45] Dec. 23, 1980

[54] FIREPLACE STOVE

[76] Inventor: Bill B. Bader, 8501 Larch Ave., Cotati, Calif. 94928

[21] Appl. No.: 953,004

[22] Filed: Oct. 20, 1978

[51] Int. Cl.[3] ..... E05C 19/06; F23L 13/02; F24C 15/02

[52] U.S. Cl. ..... 126/193; 49/394; 126/121; 126/197; 126/286; 126/288; 292/67; 292/204

[58] Field of Search ..... 126/66, 67, 197, 135, 126/136, 120, 121, 123, 126, 77, 80, 193, 198, 191, 192, 287, 289, 290, 288, 286; 49/394; 292/67, 68, 202, 204

[56] References Cited

U.S. PATENT DOCUMENTS

| | | | |
|---|---|---|---|
| 400,689 | 4/1889 | Keyser | 126/136 X |
| 2,042,297 | 5/1936 | Craighead | 292/19 |
| 2,199,875 | 5/1940 | Brogden | 126/77 X |
| 2,430,393 | 11/1947 | Elmore et al. | 126/121 X |
| 2,743,720 | 5/1956 | Dollinger | 126/121 |
| 2,799,423 | 7/1957 | Kaye | 292/218 X |
| 3,025,093 | 3/1962 | Millman | 292/204 |
| 3,267,613 | 8/1966 | McQuiston | 292/204 X |
| 3,782,765 | 1/1974 | Wallyn | 292/204 X |
| 3,952,721 | 4/1976 | Patterson | 126/126 X |
| 4,091,794 | 5/1978 | Stites | 126/121 |
| 4,163,440 | 8/1979 | Stultz | 126/77 X |

FOREIGN PATENT DOCUMENTS

| | | | |
|---|---|---|---|
| 547894 | 6/1956 | Belgium | 126/121 |
| 512880 | 2/1921 | France | 126/289 |

*Primary Examiner*—Allan N. Shoap
*Attorney, Agent, or Firm*—Melvin R. Stidham

[57] ABSTRACT

A fireplace stove comprising a generally rectangular metallic housing adapted to extend into a fireplace opening, with penetration being limited by a flange around the housing which engages and seals against the face of the fireplace. A metallic inner fire shell is closely spaced within the inner surfaces of the housing to provide airflow passages between them. An air inlet with a blower is located at the lower end of one side of the housing and a narrow, hot air outlet extends across the top. Air is directed to flow almost completely around the fire shell for maximum heating. An air inlet with a blower is located at the lower end of one side of the housing and a narrow, hot air outlet extends across the top. Air is directed to flow almost completely around the fire shell for maximum heating. An access door is held in sealed engagement by a spring latch and a combustion air duct in the door extends into the interior so that the air entering thereto is preheated before actual contact with the fire. A butterfly valve damper is mounted in the duct and may be operated from outside the box.

4 Claims, 8 Drawing Figures

FIREPLACE STOVE

BACKGROUND OF THE INVENTION

The conventional fireplace is an extremely inefficient heating system in that much of the heat of combustion is simply lost out the fireplace. Moreover, the gases rising up the flue create a vacuum which draws in warm air from the room, further defeating its own purpose.

OBJECTS OF THE INVENTION

It is an object of this invention to provide a fireplace stove which draws little or no air from the room for combustion and projects clean heated air into the room.

It is a further object of this invention to provide a fireplace stove which is economical to manufacture and efficient in operation.

It is a further object of this invention to provide a fireplace stove which heats a room by radiation as well as by forced air circulation.

Other objects and advantages of this invention will become apparent from the description to follow, particularly when read in conjunction with the accompanying drawings.

SUMMARY OF THE INVENTION

In carrying out this invention, I provide a generally rectangular metallic box or housing which is of a size and shape in cross-section to fit within a fireplace opening, and is of sufficient depth that a substantial portion extends outside of the fireplace for heating by radiation, while the remainder, including a combustion exhaust opening are contained within. An inner fire shell is sealed around its leading edges to the front wall of the box to isolate surrounding air from the fire, and is closely spaced within the sides and top of the box. Outlet openings are in the front wall across the top of the box and an inlet opening with blower is located in a side wall near the bottom. Baffles prevent air from circulating directly up that particular side wall so that the airflow is across the bottom, up the sides and back, and across the top for maximum heating before being projected into the room. A door carried on the front wall has a spring biased latch which holds the door in firm sealing engagement with the front wall and a duct extends through the access door well into the firebox so that air entering therethrough is preheated. A butterfly valve damper is carried in the duct and operated from outside the stove so that the amount of air entering the firebox can be controlled.

DESCRIPTION OF A PREFERRED EMBODIMENT

Figure 4:
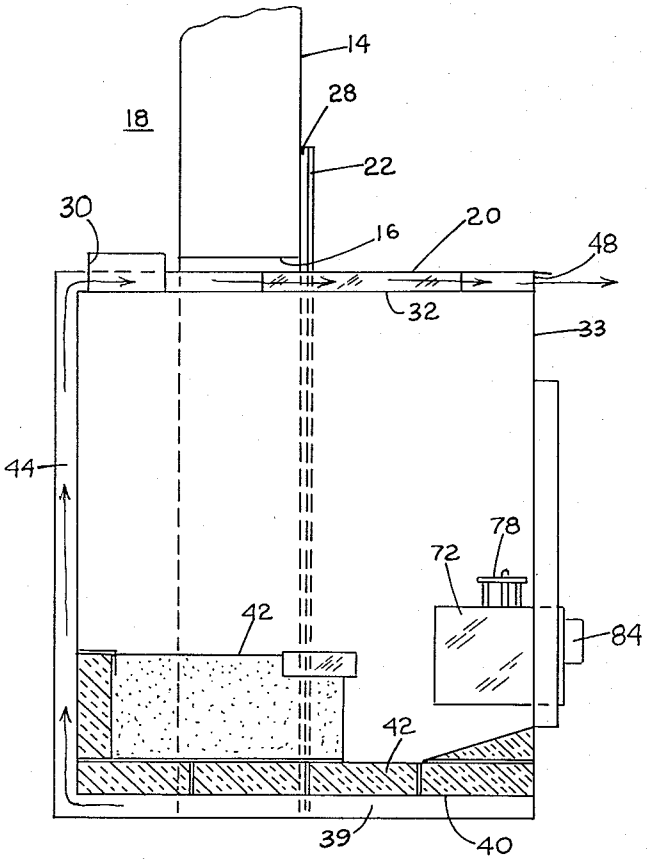

Referring now to the drawings with greater particularity, the fireplace stove 10 of this invention is shown mounted in a more or less conventional fireplace 12 of brick or the like including a face 14, a hearth 15, an opening 16 (FIG. 4) and a flue 18.

The fireplace stove 10 comprises a metallic box or housing 20 which is supported on the hearth 15 and is of dimensions in cross-section to fit within the fireplace opening 16 with penetration into the fireplace being limited by a steel flange plate 22 around the sides and top of the housing 20 so that there are substantial surface areas of the sides 24 and the top 26 which, when heated, radiate heat into the room. Besides limiting the penetration of the box 20, the flange 22 seals against the face of the fireplace 14 to restrict intake of air from the room and prevent return of smoke into the room. If desired, a gasket 28 (FIG. 4) of a suitable material, such as Fiberglas may be provided around the flange for this purpose. The penetration of the box 20 into the fireplace 12, as determined by the flange 22 is sufficient that exhaust openings from the interior of the box, open into the fireplace to be exhausted up the flue 18.

Figure 5:
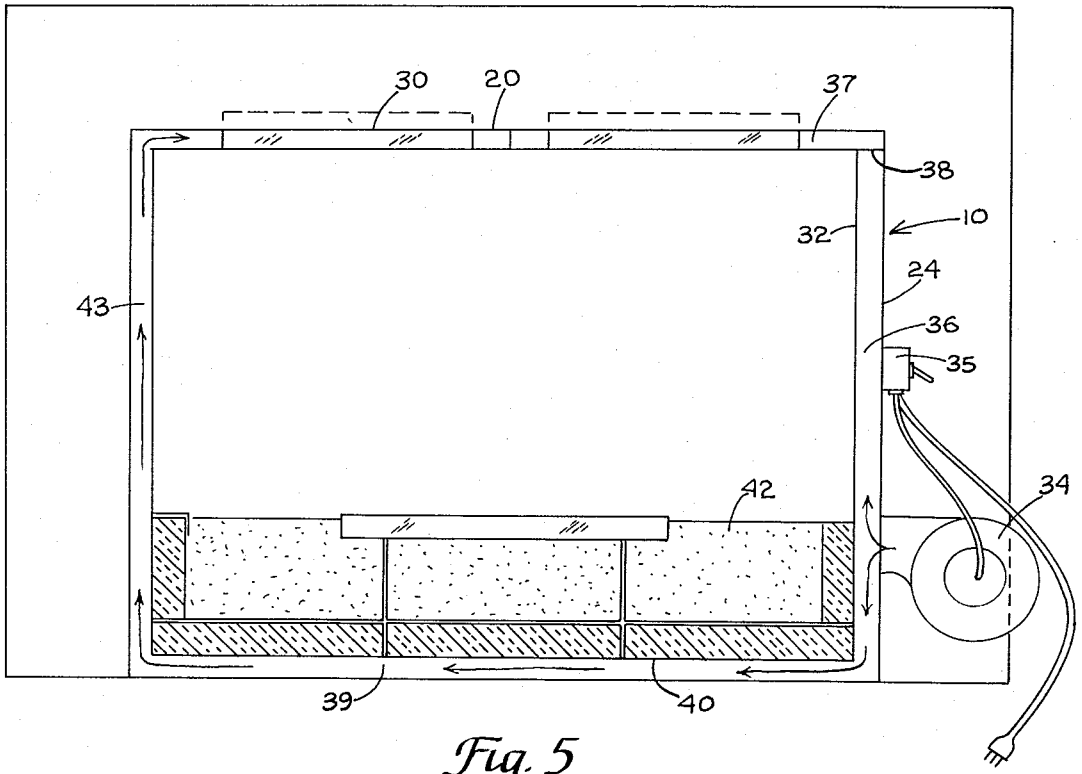
FIGS. 4 and 5 are vertical section views of the fireplace stove.
Figure 6:
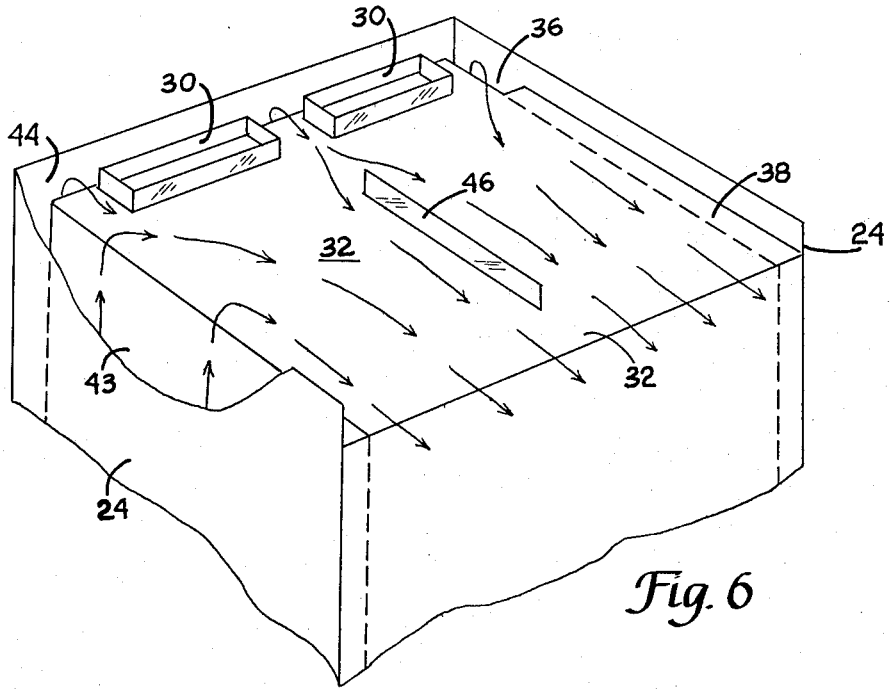
FIG. 6 is a partial view of the stove with parts broken away to illustrate the circulating airflow.

Welded to the front wall 33 of the box 20 around the periphery of its front edges is a generally concentric rectangular inner fire shell 32 of sheet steel or the like that is spaced closely to the inner surface of the housing box to provide a narrow airflow space of, say one inch or less, between them. Air flowing through such space is isolated from the interior of the fire shell by the seal weld around the periphery of the front edges. A blower 34 with on/off switch 35 is mounted on one side wall 24 to direct air from the room into the space 36 (FIG. 5) between that side wall 24 and the shell 32. Preferably, the upward course through the space 36 is blocked off at 38 to prevent direct upward flow of air to the space 37 above the shell 32 and under the top wall 20, and to force the circulation, as indicated by arrows, across the passageway 39 under the bottom wall 40 of the fire shell on which are supported fire bricks 42. From the bottom passageway 39, flow of heated air is upward through the opposite side passage 43 and the rear passage 44, and then forwardly across the top passageway 37 as directed by vanes 46 (FIG. 6) to exit through openings 48 across the top of the front wall 33.

Pivotally mounted on the front wall 33 of the housing 20 as by means of hinge pins 48 removably received in bushings 50 is a fire access door 52. If desired the door 52 may be removed by lifting the hinge pins 48 to provide an open fireplace effect or to be replaced by a similarly mounted screen (not shown). Journalled in a bushing 56 carried on the access door 52 is a latch shaft 58 which may be turned by pivoting a lever 60 integral therewith.

Figure 2:
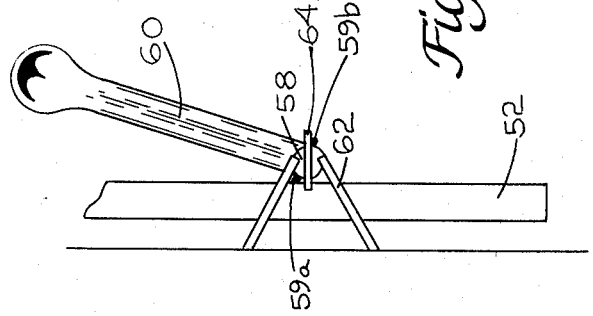
FIGS. 2 and 3 are end views of an access door latching mechanism in different stages of operation.
Figure 3:
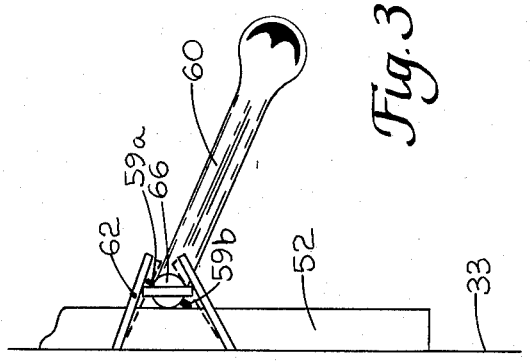
Figure 1:
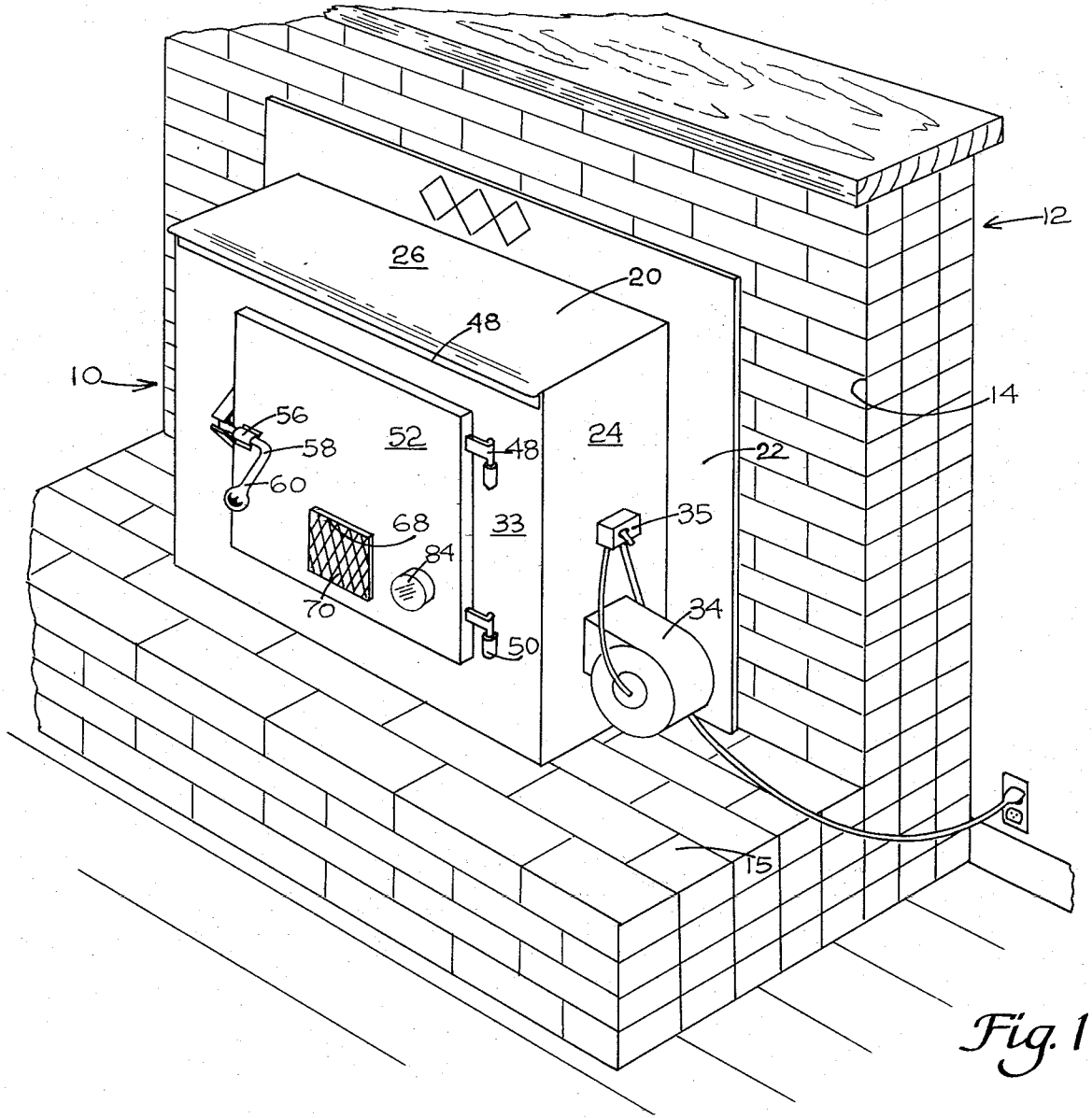
FIG. 1 is a view in perspective of the fireplace stove of this invention mounted in a fireplace.

As seen particularly in FIGS. 2 and 3, a pair of opposing latch fingers 62 are welded to the front wall 33 to extend therefrom in converging relationship. The end of the latch shaft 58 is flat in cross section, narrow at 64 so that when turned to the position shown in FIG. 2, as determined by an open position stop **59*a* it fits easily between the converging latch fingers to allow the access door 52 to be opened or closed. Then, with the lever 60 pivoted to the position shown in FIG. 3, as determined by the lock position stop 59*b*, the wide dimension 66 is turned to engage and tend to spread converging latch fingers 62 away from their normal positions, shown in phantom in FIG. 3. Hence, the flexural strength of the latch fingers 62 seeking to return to the normal configuration forces the latch pin 58 and, hence, the door 52 into firm sealing engagement with the front wall 33**.

Figure 7:
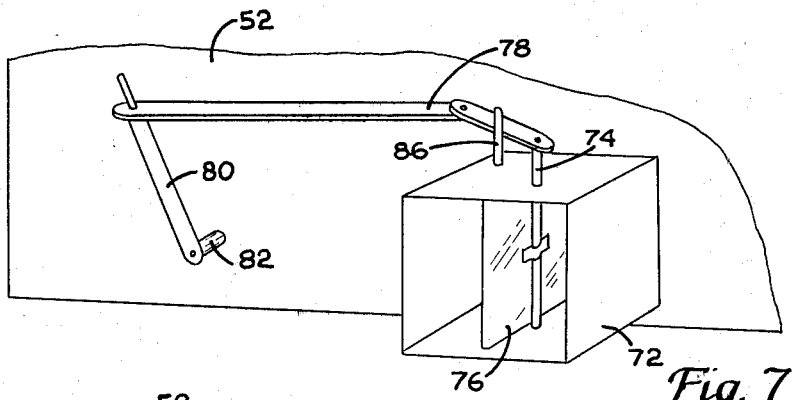
FIGS. 7 and 8 are partial views in perspective showing operation of cumbustion air intake.
Figure 8:
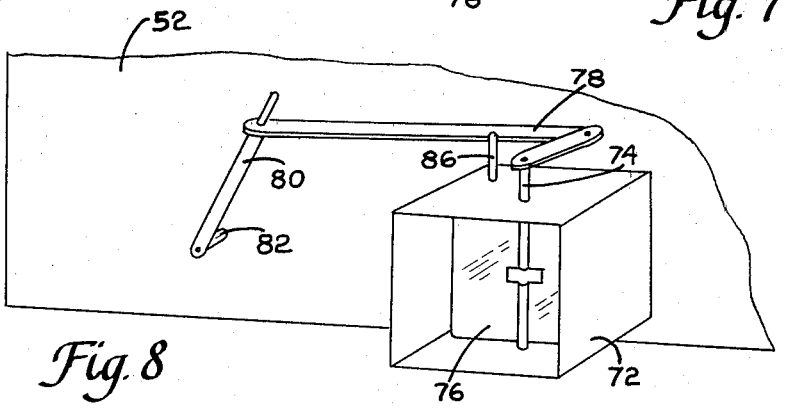

Cut into the fire access door 52 is a combustion air intake or vent opening 68 covered by a steel screen 70 to prevent sparks from being projected into the room. Extending inward from the vent opening 68 is an intake duct 72 (FIGS. 7 and 8), which may be generally rectangular in cross section as indicated. Mounted on a stem 74 extending across and rotatable on, the duct 72 is a butterfly valve damper 76 which may be turned through 90° between the full open position shown in FIG. 7 and the closed position shown in FIG. 8. A suitable linkage 78, 80, is operated by partial rotation of a shaft 82 by turning a control knob 84 on the outside of the fire access door for operation between such open and closed position. A pin 86 carried on the duct 72 prevents the linkage from pivoting over center. Hence, the control knob 84 may be turned as desired to observe the fire within the shell 32 or to provide the desired amount of air intake for combustion.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. In a fireplace stove having an access opening therein:

a door hinged on said stove to open and close said access opening:

a latch shaft journalled on and disposed parallel to said door;

means for turning said latch shaft;

a pair of metal strip latch fingers having substantial flexural strength extending outward from said front wall in converging relation with a space between the distal ends thereof to receive the end of said latch shaft therebetween said fingers being biased toward said converging relation and able to flex therefrom;

said end of said latch shaft being narrow along one cross-sectional axis to be received between said fingers and relatively wide along the other cross-sectional axis to bias the converging fingers apart when said latch shaft is rotated through about 90°.

2. The fireplace stove door defined by claim 1 wherein:

said converging fingers have flexural strength to bias said latch shaft and door firmly against said front wall.

3. The fireplace stove door defined by claim 2 wherein:

said converging fingers engage the remote edges of said end of the latch shaft so that the flexural strength thereof pulls said shaft end toward said front wall.

4. The fireplace stove door defined by claim 1 including:

a vent opening in said front door;

a butterfly valve damper rotatably mounted on said door to open and close said vent opening by rotating through about 90°; and means on the outside of said door for turning said damper.

* * * * *